United States Patent [19]

Matsumoto

[11] 4,198,720

[45] Apr. 22, 1980

[54] DIRT REMOVER FOR WATER TANK

[76] Inventor: Akio Matsumoto, 5-3-2-304, Higashi-Murayama-shi, Tokyo, Japan

[21] Appl. No.: 942,378

[22] Filed: Sep. 14, 1978

[30] Foreign Application Priority Data

Nov. 15, 1977 [JP] Japan ..... 52-152255[U]

[51] Int. Cl.[2] ..... E04H 3/20

[52] U.S. Cl. ..... 15/1.7; 15/257.9; 209/418; 294/55

[58] Field of Search ..... 15/1.7, 257.1, 257.9; 209/417–419; 294/55

[56] References Cited

U.S. PATENT DOCUMENTS

| | | | |
|---|---|---|---|
| 277,266 | 5/1883 | Godfrey | 15/257.9 |
| 3,188,668 | 6/1965 | Buckelew | 15/1.7 |
| 3,220,037 | 11/1965 | Ruhling | 15/1.7 |
| 3,979,146 | 9/1976 | Berg | 15/257.1 X |
| 4,003,100 | 1/1977 | Whitaker | 15/1.7 |
| 4,053,412 | 10/1977 | Stix | 15/1.7 X |

*Primary Examiner*—Edward L. Roberts

*Attorney, Agent, or Firm*—Wenderoth, Lind & Ponack

[57] ABSTRACT

A dirt remover for a water tank, which can readily remove not only the dirt floating on the water surface and the dirt suspended in the water but also the dirt settling to the tank bottom without inflicting any injury on the bottom surface of the tank, includes a frame formed of a rear frame member, two lateral frame members extending forward from the opposite ends of the rear frame member, and a frontal frame member set in position straight between the leading ends of the two lateral frame members. A net is hung from the inner sides of the frame loosely enough for the middle portion thereof to sag down, the net forming a scooping portion in conjunction with the frame. A handle has a leading end thereof attached to the rear frame member of the frame, the handle serving for the operation of the scooping portion. A plate-shaped sliding piece made of a material possessing proper degrees of rigidity and elasticity is fastened to the frontal frame member of the frame throughout the entire length thereof in such a way that the leading end of the sliding piece will protrude from the scooping portion.

4 Claims, 6 Drawing Figures

DIRT REMOVER FOR WATER TANK

BACKGROUND OF THE INVENTION

This invention relates to a dirt remover suitable for the removal of dirt floating, suspended or settling in water tanks such as swimming pools and water storage tanks.

Large water tanks such as swimming pools and water storage tanks which are generally installed outdoors are in most cases left uncovered because of their particular uses and their invevitable possession of large openings. Thus, they have the disadvantage that falling leaves and various forms of dirt drift into the tanks and pollute the water held therein. Particularly in the case of swimming pools, hair from swimmers, loose threads from swimmers' suits and the like frequently pollute the water held therein.

Because of such pollution, swimming pools and water storage tanks which are required to retain the quality of their water above a fixed level are provided with means of purification capable of cyclically filtering water to remove dirt together with defiling matter. The dirt of light weight which floats on the water surface and the dirt of heavy weight which settles to the water bottom fail to mingle into the circular flow of water and defy effective removal by such means as are adapted to remove the dirt from the water being circulated therethrough. For this reason, there has been often followed a practice of scooping the dirt in the water tank with a bag-shaped net attached to the leading end of a handle. Conventional scooping devices of this kind have a circular frame attached to the end of a handle and a net hung from the frame. They are, accordingly, capable of removing the dirt floating on the water surface or suspended in the water but are unsuitable for scooping the dirt settling to the bottom of the water tank. Particularly the dirt consisting of fine particles such as hair from human bodies and loose threads from suits which occur in swimming pools and the dirt of high specific gravity consisting of pebbles and broken iron pieces are considered hardly capable of being scooped by such conventional means.

This invention relates to a dirt remover developed in a view of such true state of affairs. An object of the invention is to provide a dirt remover adapted so as to permit ready removal of not only the dirt floating on the water surface and suspended in the water but also the dirt settling to the water bottom in water tanks. Another object of the present invention is to provide a dirt remover capable of safely scooping the dirt settling to the tank bottom without scratching the paint applied to coat the bottom or inflicting any injury to the bottom surface.

SUMMARY OF THE INVENTION

To accomplish the objects described above according to the present invention, there is provided a dirt remover which uses a straight frontal edge member in the forward part of a frame attached to the leading end of a handle and, moreover, attaches to the frontal edge member a plate-shaped sliding piece made of a material such as foamed polyethylene excelling in resistance to water and possessing proper degrees of rigidity and elasticity, so that the sliding piece prevents the leading end of the frame from coming into direct contact with the tank bottom and, when slid on the tank bottom, scrapes up the settling dirt and conveys it backwardly into a net having the edges thereof fastened to the inner sides of the frame.

Figure 1:
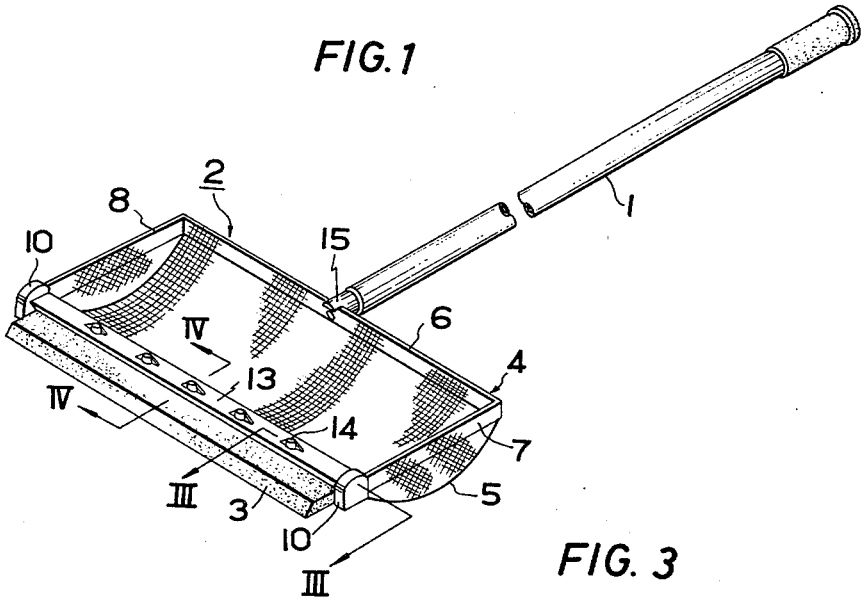
FIG. 1 is a perspective view of the dirt remover of this invention for use with a water tank, with part of the handle thereof cut away for convenience of illustration.

Now, the present invention will be described hereinbelow with reference to the accompanying drawings.

DETAILED DESCRIPTION OF THE INVENTION

In the acccompanying drawings, the handle with which the dirt remover of this invention is operated is denoted by symbol 1, the scooping portion attached to the leading end of the handle by symbol 2 and the sliding piece provided along the frontal edge of the scooping portion by symbol 3. The scooping portion 2 mentioned above is composed of a frame 4 and a net 5 hung from the inner sides of the frame 4, and the frame 4 is composed of a rear frame member 6, lateral frame members (left and right) 7, 8 and a frontal frame member 9.

In the present preferred embodiment, the frame 4 is formed in a rectangular shape by bending a bar-shaped strip of aluminum in the shape of three sides of a rectangle for thereby forming the rear frame member 6 in the middle and the two lateral frame members 7, 8 of an equal length perpendicularly extended from the rear frame member 6, fastening connecting members 10, 10 of a plastic material to the leading ends of the lateral frame members 7, 8 and setting the frontal frame member 9 made of a bar-shaped strip of aluminum in position between the connecting members.

The connecting members 10, 10 mainly serve the purpose of connecting the lateral frame members 7, 8 with the frontal frame member 9. They are each possessed of a first insertion hole **11*a* opening to the rear side for admitting the leading end of the relevant lateral frame member and a second insertion hole 11*b* formed perpendicularly relative to the first insertion hole and opening laterally towards the center of the frontal frame member. Attachment of the connecting members to the lateral frame members 7, 8, therefore, can be accomplished by inserting the leading end of the lateral frame member 7 into the insertion hole 11*a* of one of the connecting members 10 and the leading end of the lateral frame member 8 into the insertion hole 11*a* of the other connecting member 10. Then the opposite ends of the frontal frame member 9 are inserted into the second insertion holes 11*b*, 11*b* which have been opposed to each other in consequence of the attachment mentioned above. As the result, the frontal frame member 9 and the lateral frame members 7, 8 are connected, completing the frame 4 in a firmly closed rectangular shape. To be more specific, in the aforementioned connecting members 10, 10 of the present preferred embodiment, the first insertion holes 11***a*, 11*a* are each formed in the shape of a rectangualr parallellepiped with a vertically oblong inner cross section substantially conforming to the outer cross section of the lateral frame members 7, 8 and the second insertion holes 11*b*, 11*b* are each formed in the shape of a rectangular parallellepiped with a horizontally oblong inner cross section such that, when the connecting members are joined with the frontal frame member 9, the major faces of the frontal frame member extend perpendicularly to the holes 11*a*, 11*b* are slightly smaller than the outer cross section at the leading ends of the corresponding frame members so that the mutual connection between the frame members can be effected by having the leading ends of the frame members forcibly inserted into the insertion holes. In addition, the connecting members 10, 10 are each provided integrally on the upper sides thereof with protuberances 12, 12 adapted to withstand percussions exerted upon the connecting members to facilitate the aforementioned insertion. The protuberances will be further discussed below.

In the case of the present preferred embodiment, because of the construction of the frame 4 formed as described above, attachment of the net 5 to the inner sides of the frame is accomplished by first having the corresponding three sides of the rectangular periphery of the net attached to the rear frame member 6 and the lateral frame members 7, 8 before the connection of the frontal frame member 9, and thereafter fastening the remaining side of the net to the frontal frame member 9.

Figure 3:
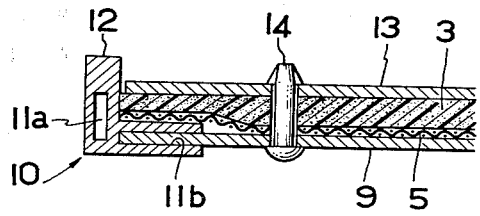
FIG. 3 is an enlarged sectioned view of part of the dirt remover taken along the line III—III of FIG. 1.
Figure 4:
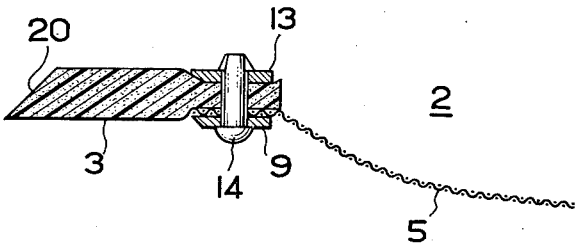
FIG. 4 is an enlarged sectioned view of part of the dirt remover taken along the line IV—IV of FIG. 1.
Figure 2:
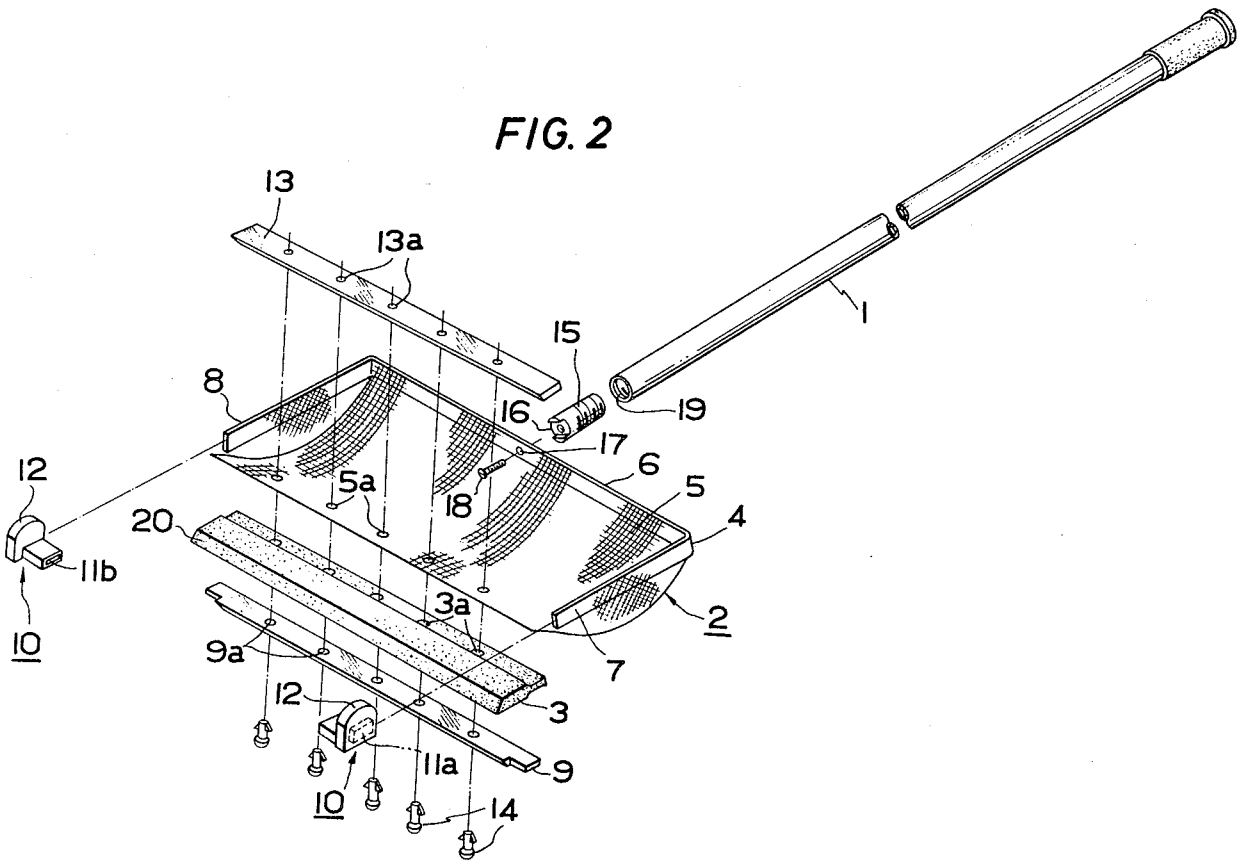
FIG. 2 is an exploded perspective view of the dirt remover of the present invention for use with a water tank.

The net 5 illustrated herein is a synthetic fiber net formed by interweaving filaments such as of polyester or polyethylene in a relatively small mesh size with a view to offering resistance to water and ensuring rapid drainage of water during use. This net is cut in an area somewhat larger than the inner area of the aforementioned frame 4. The three sides of the net along the rear edge and the lateral edges are each folded back to form a cylindrical pouch, so that the attachment of these sides of the net to the rear frame member 6 and the lateral frame members 7, 8 which have been formed integrally by bending one bar-shaped strip of aluminum will be accomplished by inserting the three sides of the frame 4 through the cylindrical pouches of the net. Of course, in this case, the net 5 hangs loosely from the frame because it has been cut in a somewhat larger area than the inner area of the frame as described above. After the net has been attached to the rear frame member 6 and the lateral frame members 7, 8 in the manner described above, the frame 4 is completed by setting the frontal frame member 9 in position between the leading ends of the lateral frame members through the medium of connecting members 10, 10. In the present preferred embodiment, the scooping portion 2 is completed and, at the same time, the sliding piece 3 is set in position by having the front edge of the aforementioned net 5 spread on the upper face of the frontal frame member 9, the aforementioned sliding piece placed on top of the front edge of the net and an auxiliary frontal frame member 13 mounted on the sliding piece and thereby allowing the front edge of the net 5 and the sliding piece 3 to be positioned between the frontal frame member 9 and the auxiliary frontal frame 13 and thereafter having plastic rivets 14 driven through the four layers at points spaced suitably in the longitudinal direction for thereby uniting the four layers into one tight assembly. (See FIGS. 2, 3 and 4.)

In this case, to ensure effective driving of the rivets 14, holes 9*a*, 13*a*, 5*a* and 3*a* for permitting passage of the rivets are perforated at the corresponding positions in the frontal frame member 9, the auxiliary frontal frame member 13, those in the net 5 and the sliding piece 3. The rivets 14 to be used herein are those of the type possessing heads at the rear ends of their shanks and arrow-shaped engaging hooks at the forward ends thereof. After the four layers have been piled up as described above, these rivets are pushed into the holes 9*a* of the frontal frame member, through the intervening holes 3*a*, 5*a* and out of the uppermost holes 13*a* of the auxiliary frontal frame member 13 until the engaging hooks at the leading ends of the rivet shanks emerge from the auxiliary frontal frame member 13. The assembly of the four layers is completed by radially spreading the engaging hooks into tight engagement with the upper surface of the frame member 13.

In the preferred embodiment, the tight union of the frontal frame member 9 and the auxiliary frontal frame member 13 has been described as being attained by use of plastic rivets. It is, of course, possible to accomplish this union by using rivets of metal material or small bolts and nuts.

Figure 5:
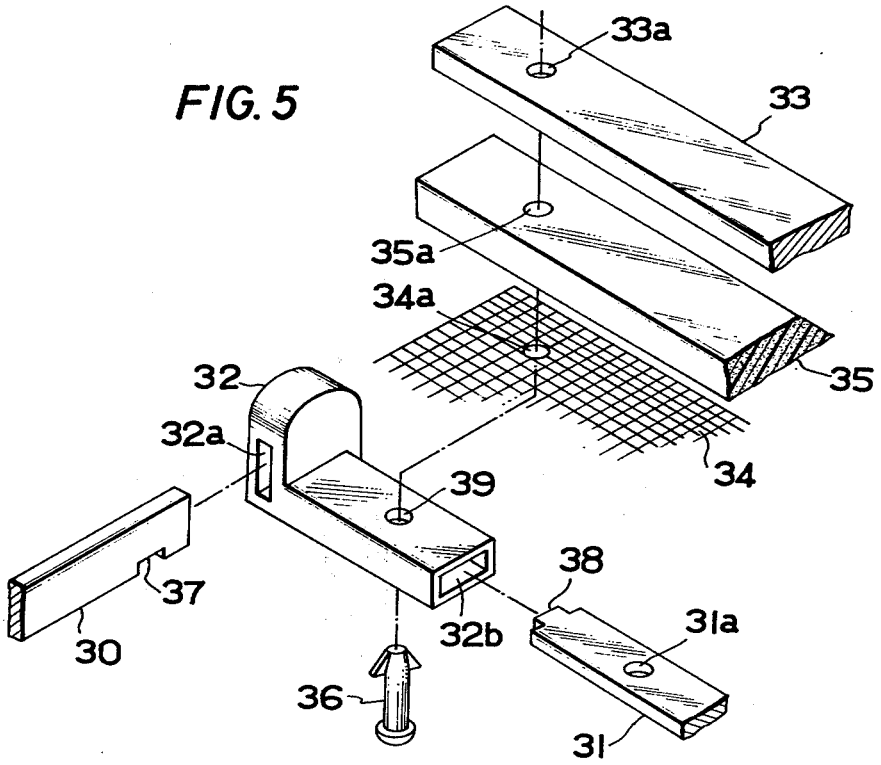
FIG. 5 is an exploded perspective view illustrating other preferred embodiments of the frontal frame member and lateral frame members of the dirt remover according to the present invention.
Figure 6:
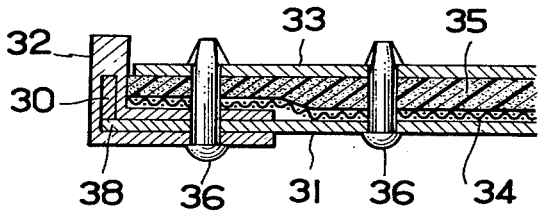
FIG. 6 is a longitudinal cross section of a portion of the elements of FIG. 5 in their assembled state.

FIG. 5 and FIG. 6 represent other preferred embodiments of the method of connection between the lateral frame members 7 (or 8) and the frontal frame member 9 described above. In FIGS. 5 and 6 , 30 denotes one of the two lateral frame members forming a part of the frame 4, 31 a frontal frame member, 32 a connecting member, 33 an auxiliary frontal frame member, 34 a net to be hung from the inner sides of the frame, 35 a sliding piece, and 36 a rivet. Comparison of the second preferred embodiment with the first preferred embodiment described above reveals the differences in that the insertion holes 32*a* and 32*b* which are formed in each connecting member 32 internally communicate with each other, that each lateral frame member has a notch 37 formed in one lateral edge close to the forward end thereof and the frontal frame member 31 has a projection 38 formed on the leading end thereof, and that one of the rivets designed to provide tight union of the frontal frame member 31 and the auxiliary front frame member 33 is driven through the aforementioned connecting member.

In the connecting member 32 which is used in the present preferred embodiment, a first insertion hole 32*a* for permitting the insertion of the lateral frame member 30 and a second insertion hole 32*b* for permitting the insertion of the frontal frame member 31 in a direction perpendicular to the insertion hole 32*a* are formed with the inner end of the second insertion hole 32*b* piercing through the lateral side of the insertion hole 32*a* for mutual communication, so that safe connection between the frontal frame member 31 and the lateral frame member is accomplished by first inserting the lateral frame member into the first insertion hole 32*a*, then inserting the frontal frame member 31 through the second insertion hole 32*b* until the leading end thereof collides into the lateral side of the lateral frame member 30 and thereafter bringing the projection 38 formed at the leading end into fast engagement with the notch 37 formed in the lateral frame member for thereby precluding easy separation of the lateral frame member from the connecting member. Moreover, the connecting member 32 has a through hole 39 vertically perforated in the portion for admitting the frontal frame member and the frontal frame member similarly has a through hole 31*a* vertically perforated at a corresponding position so that one rivet 36 driven through the registered holes 39 and 31*a* will prevent the frontal frame member from easily separating from the connecting member. Similarly to the foregoing preferred embodiment, the rivet is passed through the hole 34*a* perforated in the net 34, the hole 35*a* perforated in the sliding piece 35 and the hole 33*a* perforated in the auxiliary frontal frame member 33 to provide tight union of the frontal frame member 31 and the auxiliary frame member 33, with the net 34 and the sliding piece 35 immovably interposed therebetween.

In short, unlike the first preferred embodiment wherein the connection of the lateral frame member 7 (or 8) with the frontal frame member 9 is accomplished simply by forcibly inserting the leading ends of these frame members into the corresponding insertion holes of the connecting member 10, the second preferred embodiment enhances the safety of the connection by causing the lateral frame member 30 and the frontal frame member 31 to be engaged with each other inside the connecting member and further securing the frontal frame member 31 to the connecting member by insertion of the rivet 36 through the frontal frame member, whereby the lateral frame member 30 and the frontal frame member 31 will not readily separate themselves from the connecting member.

The sliding piece 3 which is held fast in position by the aforementioned tight union of the frontal frame member 9 and the auxiliary frontal frame member 13 is formed of a material such as highly foamed polyethylene which excels in resistance to water and possesses proper degrees of rigidity and elasticity. This sliding piece is formed in the shape of a plate having a thickness sufficient to confer proper degrees of rigidity and elasticity to the sliding piece. The sliding piece is formed in the shape of a strip having a length substantially equal to the length of the frontal frame member 9 and a width greater than the width of the frontal frame member so that, when it is immovably fastened between the frontal frame member 9 and the auxiliary frontal frame member 13, one edge (frontal edge) 20 thereof will protrude from the frontal frame member 9 substantially throughout the entire length of the frame 4 and the entire length of the front edge of the scooping portion. In the present preferred embodiment, the frontal edge 20 of the sliding piece which protrudes as described above is cut aslant in the shape of an edge in a cutting blade in order that the sliding piece may come into tight contact with the bottom of the water tank.

The handle 1 is formed of a metal pipe. This handle 1 is attached to the frame 4 through the medium of a connecting member 15.

The connecting member 15 mentioned above is formed of a round bar of plastic material having a tapered peripheral surface. The connecting member is provided at the leading end thereof with a notch 16 of sufficient size to receive the rear frame member 6 of the frame 4. Attachment of this connecting member 15 to the frame is accomplished by setting the rear frame member in position within the notch 16 and inserting a screw 18 through a hole 17 perforated in advance in the rear frame member into a hole drilled in advance in the connecting member 15. The handle 1 has an internal thread 19 formed on the inner surface of the opening at the leading end thereof. The handle is then connected to the frame 4 by admitting the leading end of the connecting member 15 into the opening and turning the handle around its axis and thereby allowing the aforementioned internal thread 19 to bite into the tapered peripheral surface of the connecting member.

The dirt remover of the present invention is constructed as described above. For actual use of the dirt remover, the dirt such as fallen leaves floating on the water surface is scooped out in the net 5 hung from the inner sides of the frame 4 when the user holds the handle in such a way as to permit about half of the scooping portion 2 to dip into the water and then moves the scooping portion horizontally. The dirt suspended in the water can be scooped out when the user holds the handle in such a way as to keep the scooping portion completely immersed in the water and then moves the scooping portion horizontally in much the same way as above. The dirt settling to the bottom of the water tank can be scooped out when the user lowers the handle until the scooping portion is completely immersed in the water and the sliding piece 3 attached to the forward end of the frame 4 comes into contact with the bottom surface of the water tank and then moves the sliding piece 3 along the bottom surface. In this case, during the forward motion of the device, the scooping portion 2 is inclined backwardly so that the sliding piece 3 protruding from the frontal edge of the scooping portion is diagonally held in contact with the bottom surface of the water tank. When the scooping portion is moved in the manner described above, the dirt deposited on the bottom surface of the water tank is scraped up by the sliding portion, then guided along the inclined upper surface of the sliding piece, led into the net 5 hung inside the frame and collected therein. With the dirt remover of the present invention, removal of the dirt in the water tank involves a work process which comprises the steps of immersing the scooping portion in the water, moving the immersed scooping portion forward, lifting the scooping portion from the water and removing the collected dirt from the scooping portion. This unit work process is repeated until the interior of the water tank becomes sufficiently clean. In the work process described above, the removal of the collected dirt from the net is readily accomplished by turning the scooping portion 2 upside down and exerting a mild impact upon the scooping portion from behind. In this case, if the frame is struck directly against the floor surface, there is a possibility that the edge portion of the net hung from the frame will sustain cuts. To avoid this disadvantage, the present invention has the connecting members 10 each provided on the upper face thereof with a protuberance 12. Thus, the impact required for the removal of the collected dirt is obtained by striking these protuberances against the floor surface or some other suitable hard surface. While the scooping work is in progress, the scooping portion 2 should not be moved backwardly, for the backward movement of the scooping portion entails dispersion of the collected dirt in the water.

The present invention provides effective removal of the dirt floating on the water surface and the dirt suspended in the water as well as the dirt settling to the bottom of the water as described above. Thus, the dirt remover of this invention can be advantageously used for the removal of dirt from water tanks such as swimming pools.

Particularly when the dirt remover of this invention is used for the removal of dirt settling to the bottom of a water tank, the sliding piece protruding from the leading end of the scooping portion has its leading edge brought into intimate contact with the bottom surface of the water tank by virtue of the elasticity of the material of which the sliding piece is made. The intimate contact enables the sliding piece to scoop up even small iron pieces. Because the sliding piece possesses the flexibility originating in its material, the sliding contact of this sliding piece with the bottom surface will not inflict any damage to the bottom surface. Thus, the dirt remover has the advantage of offering safety of use.

What is claimed is:

1. A dirt remover for removing dirt from a water tank, said dirt remover comprising:

a frame formed of a rear frame member, two lateral frame members extending forwardly from opposite ends of said rear frame member, and a straight frontal frame member positioned between leading ends of said two lateral frame members;

two connecting members for connecting opposite ends of said frontal frame member to respective said leading ends of said two lateral frame members, each said connecting member having a first insertion hole for receiving therein the said leading end of the respective said lateral frame member, and a second insertion hole for receiving therein the respective said end of said frontal frame member, said first and second insertion holes extending perpendicular to each other, and each said connecting member having extending therefrom an integrally formed protuberance;

a net hung from inner sides of said frame loosely enough for a middle portion of said net to sag downwardly, said net and frame forming a scooping portion;

a handle including a leading end attached to said rear frame member of said frame, said handle forming means for manipulating said scooping portion; and a plate-shaped sliding piece made of a material having desired degrees of rigidity and elasticity, said sliding piece being attached to said frontal frame member of said frame throughout the entire length thereof, said sliding piece having a leading edge protruding outwardly from said scooping portion.

2. A dirt remover as claimed in claim 1, wherein said frame is rectangular-shaped.

3. A dirt remover as claimed in claim 1, wherein said plate-shaped sliding piece is formed of highly foamed polyethylene.

4. A dirt remover as claimed in claim 1, wherein said frontal frame member comprises two straight bars each having therein through-holes, said two straight bars being positioned with the front edge of said net and the rear edge of said sliding piece interposed therebetween, and rivets extending through said through-holes and tightly joining said two bars, said front edge of said net and said rear edge of said sliding piece.

* * * * *